US008295976B2

(12) United States Patent
Moreaux

(10) Patent No.: US 8,295,976 B2
(45) Date of Patent: Oct. 23, 2012

(54) METHOD AND DEVICE FOR DETERMINING THE DEGREE OF FILLING OF A CONTAINER WITH FILLED ENVELOPES

(75) Inventor: Michel Moreaux, Chelles (FR)

(73) Assignee: Mag Systemes S.A.S., Saint Denis, La Plaine (FR)

( * ) Notice: Subject to any disclaimer, the term of this patent is extended or adjusted under 35 U.S.C. 154(b) by 1036 days.

(21) Appl. No.: 11/947,420

(22) Filed: Nov. 29, 2007

(65) Prior Publication Data

US 2008/0131236 A1 Jun. 5, 2008

(30) Foreign Application Priority Data

Nov. 30, 2006 (FR) ..... 06 55215

(51) Int. Cl.
*G06F 7/00* (2006.01)

(52) U.S. Cl. ..... 700/217

(58) Field of Classification Search ..... 700/223, 700/224; 209/584, 583
See application file for complete search history.

(56) References Cited

U.S. PATENT DOCUMENTS

| | | | | |
|---|---|---|---|---|
| 5,142,482 | A | 8/1992 | Sansone | |
| 7,050,875 | B2 * | 5/2006 | Cribbs et al. | 700/110 |
| 7,741,575 | B2 * | 6/2010 | Bowers et al. | 209/584 |
| 2003/0118384 | A1 | 6/2003 | Moriyama | |
| 2003/0233816 | A1 | 12/2003 | Klapp et al. | |
| 2004/0065596 | A1 * | 4/2004 | Hanson | 209/584 |
| 2004/0098948 | A1 | 5/2004 | Caporali et al. | |
| 2004/0245158 | A1 | 12/2004 | Redford | |
| 2005/0004695 | A1 | 1/2005 | Cribbs | |
| 2005/0107910 | A1 * | 5/2005 | Hanson et al. | 700/223 |
| 2005/0280833 | A1 | 12/2005 | Dian et al. | |
| 2006/0018696 | A1 * | 1/2006 | Mori et al. | 399/407 |
| 2006/0108266 | A1 * | 5/2006 | Bowers et al. | 209/584 |

FOREIGN PATENT DOCUMENTS

| | | | |
|---|---|---|---|
| DE | 3843300 | A1 | 7/1989 |
| DE | 4216146 | C1 | 12/1993 |
| DE | 19600231 | A1 | 7/1997 |
| DE | 19647973 | C1 | 9/1997 |
| DE | 10326145 | A1 | 12/2004 |
| EP | 0615213 | A2 | 9/1994 |
| EP | 0657712 | A2 | 6/1995 |
| EP | 0878399 | A1 | 11/1998 |
| EP | 1340625 | A | 9/2003 |
| EP | 1340625 | A2 | 9/2003 |
| WO | 2006/087622 | A | 8/2006 |

OTHER PUBLICATIONS

Notice of Opposition in EP Patent 1927546.
Notice of Opposition in EP Patent 1927546 with English Translation.

* cited by examiner

*Primary Examiner* — Ramya Burgess
(74) *Attorney, Agent, or Firm* — George M. Macdonald; Charles R. Malandra, Jr.; Steven J. Shapiro

(57) ABSTRACT

A system and method for determining the degree of filling of a container with filled envelopes is described including dynamically determining the real thickness of each of the filled envelopes of a plurality of filled envelopes before it is loaded into the container and evaluating the degree of filling of the container on the basis of the real thicknesses of envelopes thus determined.

20 Claims, 4 Drawing Sheets

METHOD AND DEVICE FOR DETERMINING THE DEGREE OF FILLING OF A CONTAINER WITH FILLED ENVELOPES

FIELD OF THE INVENTION

The invention relates to a method and device for determining the degree of filling of a container with filled envelopes.

BACKGROUND OF THE INVENTION

In known manner in enveloping machines, documents are inserted into envelopes and the envelopes thus filled are then sealed before being loaded into cases of cardboard or plastic.

The number of envelopes capable of being contained in a case varies according to the thickness of those envelopes. It should be noted that the postal services in particular in France have decreed a certain number of rules relating to filling of the cases and identification thereof. Concerning the filling of the cases, these rules are the following:

- the play between the envelopes and the inside walls of the case must be sufficient to be able to slide in a hand and thus enable a packet of envelopes to be taken;
- the play between the envelopes and the inside walls of the case must not be greater than ten centimeters or so in order to avoid the envelopes being dispersed within the case.

The rules of identification decreed by the postal services are the following:

- the envelopes contained in a case must be counted and, in certain instances, identified;
- the cases must be identified by a standard label.

In known manner, when the envelopes leave an enveloping machine, they are grasped by an operator who then loads them into a case in order to fill the latter. Given the constraints mentioned above, the loading of the envelopes into cases by an operator proves to be a delicate matter if it is desired to comply with the filling rules. Furthermore, the checks necessary to ensure the compliance with those rules increase the duration of the tasks of the operator and are liable to generate errors.

The present invention therefore aims to mitigate at least one of the drawbacks mentioned above by providing a method of determining the degree of filling of a container with filled envelopes, characterized in that the method comprises the following steps:

- dynamically determining the real thickness of each of the filled envelopes of a plurality of filled envelopes before it is loaded into the container,
- evaluating the degree of filling of the container on the basis of the real thicknesses of envelopes thus determined.

The invention thus makes it possible to determine dynamically, i.e. in real time, the degree of filling of a container with envelopes on the basis of the real thicknesses of the envelopes loaded into that container. This method is particularly effective when the envelopes contained in the container do not all have the same thickness. By virtue of the dynamic determination of the thickness of each envelope, the filling of the container can thus be controlled and optimum filling be carried out given the constraints imposed by the postal services. It is thus possible to determine when the container has been filled and thus when the operator must move the latter and put an empty container in its place.

Furthermore, the method makes it possible to know how many envelopes are contained in the container.

Moreover, this manner of determining the degree of filling with envelopes of the container is more reliable than a solution consisting of determining the thickness of the envelopes upstream on the basis of the number of documents of known thicknesses that they contain. More particularly, envelopes of which the thickness has already been calculated by computer means may, for example, never reach the container, which renders the predetermination of its filling imprecise. Moreover, the setting up of calculation algorithms on a production line may sometimes prove to be costly.

According to another aspect, the invention also relates to a method of loading a container with filled envelopes comprising the steps of:

- conveying a plurality of filled envelopes from an enveloping machine to a loading station,
- loading the filled envelopes into the container, characterized in that the method further comprises the following steps:
- dynamically determining the real thickness of each of the filled envelopes before it is loaded into the container,
- evaluating the degree of filling of the container on the basis of the real thicknesses of envelopes thus determined.

The method according to this other aspect has the same advantages as those set forth above for the method of determining the degree of filling of a container with filled envelopes and they will therefore not be repeated here.

According to a feature, the degree of filling of the container is also determined on the basis of the internal dimensions of the container. These items of data may vary and are input into the device for implementing this method by an operator.

According to a feature, the method comprises a step of totaling the sum of the determined real thicknesses for the plurality of filled envelopes.

According to one feature, the selection method comprises the following steps:

- comparing the sum of the determined real thicknesses for the plurality of filled envelopes with respect to a predetermined threshold.
- and, depending on the result of the comparison, deciding as to the identification of the last envelope of which the thickness has been determined or of the first envelope of the following plurality of envelopes, in order to indicate that the container is full. Thus, when the total of the determined thicknesses reaches the threshold which depends on the internal dimensions of the container, means are provided for identifying the last envelope of which the thickness has been determined or else the next envelope of the following plurality of envelopes and of which the thickness will be determined. By virtue of this identification, the operator who loads the envelopes into the container knows that the container is filled with the loading of that last envelope or that it is already filled without the latter and that he may thus change the container.

According to a feature, the identification of the envelope is carried out by a marking operation of that envelope. The identification by marking of the envelope enables the operator to visually locate the envelope which will lead to a change in container. This marking may for example take the form of a line of color applied to the edge of the envelope.

According to a feature, dynamically determining the real thickness of a filled envelope is carried out by at least one thickness measurement. By measuring the real thickness of each envelope it is possible to reliably determine the degree of filling of the container. The measurement carried out is, for example, an optical measurement.

According to a feature, to make the thickness measurement, the following steps are carried out:

sending at least one electromagnetic signal from a signal source towards a reference surface and receiving what is referred to as the reference signal reflected by the reference surface, sending at least one electromagnetic signal towards the reference surface which is placed on the path of a filled envelope and which is brought closer to the signal source on passage of a filled envelope and receiving what is referred to as the measurement signal reflected by the reference surface, measuring the real thickness of the envelope on the basis of the reference signal and measurement signal that are reflected by the reference surface.

According to a feature, the method comprises a step during which air is expelled from the envelope in order to determine the real thickness of the latter. By driving out air from the envelope, the dynamically determined thickness is even closer to the reality. Thus a possible volume of air contained in the envelope is taken into account, which a solution calculating the thickness of the envelope on the basis of the number of documents contained therein would not enable.

It will be noted that the invention makes it possible to take into account all the types of folding of documents in the envelopes: folding in two for insertion of documents in an envelope of C5 type, or folding in three for the insertion of the document in an envelope of C6-5 type.

According to a feature, the reference surface placed on the path of the envelopes is both flexible so as to elastically deform on passage of a filled envelope and sufficiently rigid to exert a compressive force on the envelope tending to expel air therefrom. The reference surface is thus used both for the measurements and also to eliminate air contained in the envelope and which would be liable to distort the measurements.

In a complementary manner, the invention relates to a device for determining the degree of filling of a container with filled envelopes, characterized in that the device comprises:

means for dynamically determining the real thickness of each of the filled envelopes of a plurality of filled envelopes before it is loaded into the container, means for evaluating the degree of filling of the container on the basis of the real thicknesses of envelopes thus determined.

According to another aspect, the invention also relates to a device for loading a container with filled envelopes comprising:

means for conveying a plurality of filled envelopes from an enveloping machine to a loading station, means for loading the filled envelopes into the container, characterized in that the device further comprises:

means for dynamically determining the real thickness of each of the filled envelopes before it is loaded into the container, means for evaluating the degree of filling of the container on the basis of the real thicknesses of envelopes thus determined.

According to a feature, the means for dynamically determining the real thickness of each of the envelopes comprise thickness measuring means.

According to a feature, the thickness measuring means are optical measuring means.

According to a feature, the optical measuring means are associated with a reference surface.

According to a feature, the thickness measuring means comprise:

means for sending at least one electromagnetic signal from a signal source towards a reference surface and for receiving what is referred to as the reference signal reflected by the reference surface, means for sending at least one electromagnetic signal towards the reference surface which is placed on the path of a filled envelope and which is brought closer to the signal source on passage of that filled envelope and for receiving what is referred to as the measurement signal reflected by the reference surface, means for measuring the real thickness of the envelope on the basis of the reference signal and measurement signal that are reflected by the reference surface.

According to a feature, the reference surface placed on the path of the envelopes is both flexible so as to elastically deform on passage of a filled envelope and sufficiently rigid to exert a compressive force on the envelope tending to expel air therefrom.

Other features and advantages will appear in the following description, which is given solely by way of non-limiting example and made with reference to the accompanying drawings, in which:

DETAILED DESCRIPTION

Figure 1A:
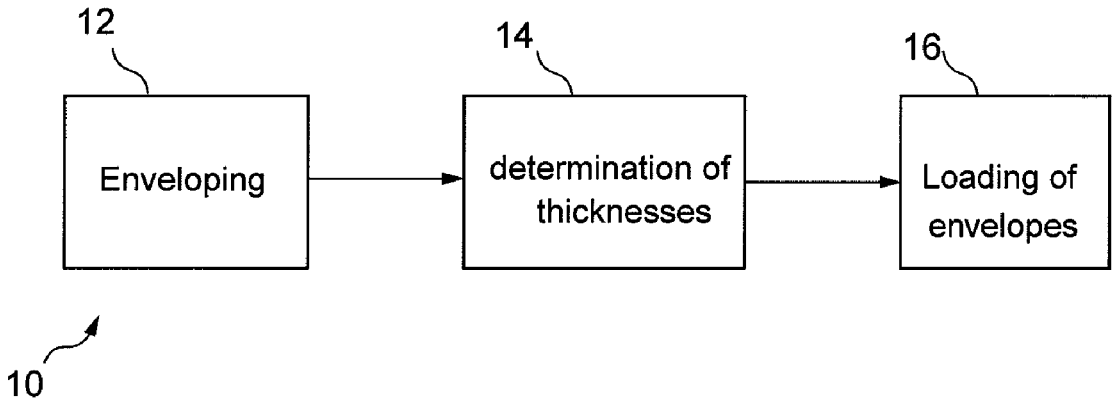
FIG. 1*a* is a general diagrammatic view of a mail processing system according to an illustrative embodiment of the invention.

As represented in FIG. 1*a* and denoted by the general reference 10 a mail processing system according to the invention comprises an enveloping machine 12 performing, on the basis of documents and empty envelopes, the insertion of documents in those envelopes and the sealing thereof.

The system also comprises a device for determining thicknesses of envelopes 14 which dynamically performs the determination of the real thickness of each of the filled envelopes coming from the enveloping machine 12.

The system 10 further comprises a station 16 for loading a container or receptacle with envelopes, which may take the form of a crate or recipient in which those envelopes must be arranged.

Figure 1B:
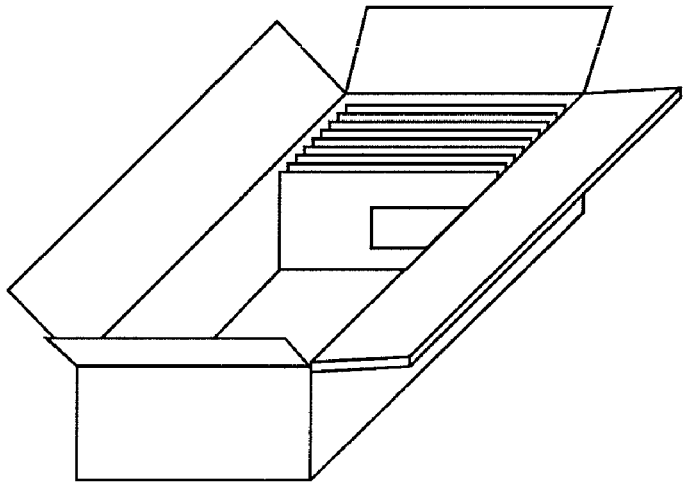
FIG. 1*b* is a diagrammatic view representing a container such as a tray in course of filling.

FIG. 1*b* represents the inside of a crate partially filled with envelopes and which is in course of filling at the loading station 16.

The internal dimensions of such a container are, for example, 120×220×500 mm and the container may contain, for example, approximately 400 envelopes.

By virtue of the dynamically determined real thicknesses of the envelopes, the device 14 makes it possible to evaluate the degree of filling of the container in course of being loaded at the station 16.

The evaluation of the degree of filling of the container with the envelopes makes it possible to finely determine the moment at which the container is sufficiently loaded taking into account those internal dimensions and the filling rules decreed by the postal services and to be complied with.

Figure 2:
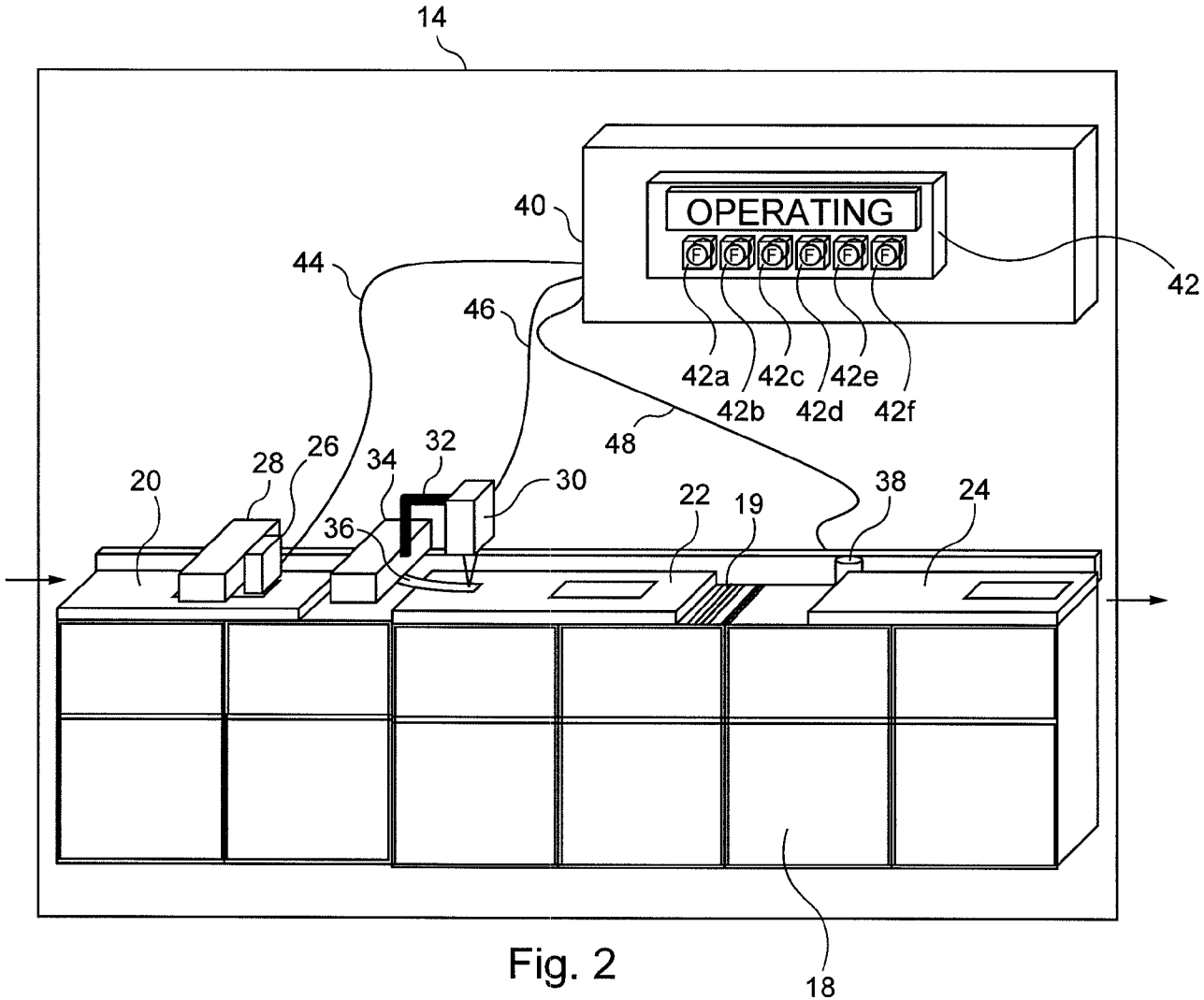
FIG. 2 is a general diagrammatic view of a device according to an illustrative embodiment of the invention.

As represented in FIG. 2, the device 14 according to an embodiment of the invention comprises a supporting structure 18 on which are positioned a plurality of envelopes of which only three, referenced 20, 22 and 24, are represented.

On the top surface of the supporting structure 18 there are provided means 19 for conveying envelopes which cause the movement thereof from left to right, in a horizontal longitudinal direction indicated by the arrows on the left and on the right of the supporting structure in that Figure (these means 19 are symbolized by slanting lines in FIG. 2). These means are of known type (conveying means) such as rotating rollers or wheels arranged parallel to each other and driven round by a motor.

The device also comprises from upstream to downstream, in the direction of movement of the envelopes:

- means for detecting the passage of an envelope that are for example produced in the form of an optic cell 26 fastened to a support 28 itself fixed to the supporting structure 18;
- means 30 for determining the real thickness of the filled envelopes.

The determining means are measuring means 30 based on the emission of an electromagnetic signal towards a reference surface 36 and the reception of the signal reflected by that surface. A first measurement of the distance between the means 30 and the reference surface is carried out for a first position, referred to as resting position, of the reference surface and a second measurement of that distance is carried out for a second position, referred to as measuring position, of the reference surface. This second position is obtained on passage of a filled envelope which enters into contact with the reference surface placed on the path of the conveyed filled envelopes.

On the basis of these two measurements of distance, the real thickness of the envelope is determined by difference. For example, these measuring means are optical measuring means which employ a measuring cell such as a laser cell. Such a measuring cell is, for example, commercialized by the company OMRON under the commercial reference ZX-LD40 and provides an analog output signal. The means 30 are mounted on an arm 32 connected to a support 34 itself fixed to the supporting structure 18.

The reference surface 36 is also fixed to the support 34 and for example takes the form of a supple metal strip or tongue of which the elasticity has been calibrated. This strip or tongue must be sufficiently flexible to be able to elastically deform by rising on the passage of an envelope between the conveying means and the strip (envelope 22 in FIG. 2) and must be sufficiently rigid in order to be able to exert a compressive force on the envelope for the purpose of expelling air for the measurement. However, the reference surface 36 must not be too rigid in order not to brake the envelope and not to prevent its movement. It will be noted, for example, that the strip 36 is formed from thin sheet metal of four tenths thickness. It should be noted that the reference surface 36 constitutes a reading surface with constant characteristics for the optical apparatus 30 (such a surface is thus preferable to the surface of the envelope) and also serves to pinch the envelope to eliminate air which is contained therein at the time at which the thickness measurement is carried out.

The operations of thickness measurement will more particularly be described with reference to FIGS. 3 and 4. The device 14 also comprises downstream of the measuring station means 38 for identifying envelopes making it possible, for example, to perform marking thereof. These means 38 are, for example, produced in the form of an ink pad held a few millimeters from the edge of the envelope in its resting position. The pad comes to deposit ink on the edge of the envelope when it is caused to move by an electrical signal. This type of envelope marking system is known per se.

The device 14 also comprises a management automaton 40 as well as a display screen 42 for example of LCD type provided with function keys 42*a*-42*f*. This control and parameterization automaton is connected to the different functional units 26, 30 and 38 already described by connections, for example respective wire connections 44, 46 and 48. The automaton may be parameterized via the aforementioned function keys which make it possible to define:

- the internal dimensions of the container, that is to say the useful format thereof, for example in centimeters;
- the delay before the marking operation (in tenths of a millisecond) relative to the position of the cell 26;
- the marking time (in tenths of a millisecond);

The delay before the thickness measurement (in tenths of a millisecond);

- the duration of the measurement (in tenths of a millisecond);
- the number of points to add to the measurement, given that a point corresponds to 4 thousandths of a centimeter;
- a multiplying factor which enables potential errors to be corrected that may arise due to the nature of the content of the envelopes (heterogeneous content, etc.).

A correction may be applied to the thickness measurement of each envelope according to the formula set out below:

$$m=a\cdot x+b$$

where m is the recorded measurement, a is the aforementioned multiplying factor (this value by default has the value 1), x is the real measurement and b is a positive or negative constant (this value by default has the value 0). It will be noted that the parameter b represents an addition of virtual thickness which makes it possible in particular to take into account the space which must be left free between the envelopes and the inside walls of the case. In general terms, the parameter b enables the compaction of the envelopes in the receiving bin (container) to be set, i.e. it enables the degree of filling thereof to be adjusted. The parameters a and b, which make it possible, if necessary, to correct the real measurement made, are fixed on installation of the system.

The parameterized automaton 40 receives information coming from means 26 for detecting the passage of an envelope, delivers instructions to the measuring means 30 to perform the measuring operations with and without the previously detected envelope with a predetermined delay (this delay takes into account the time necessary for the envelope to move from the means 26 to the measuring station), carries out the determination of the thickness of the envelope 22 and totals the thickness thus measured with the thicknesses measured for the preceding envelopes.

When the total of these thicknesses reaches or exceeds a threshold that can be parameterized (this threshold takes into account the internal dimensions of the container and the postal requirements for filling), the automaton 40 gives instructions to the identification means 38 in order to visually locate the last envelope, for example the envelope 22.

The identification of this envelope will serve as a reference for an operator operating at the loading station in order to indicate to him that a change of container must occur.

By way of a variant, the identification of the last envelope of which the thickness has been determined and which will trigger the change of container may be carried out by other means such as an audio signal transmitted by the automaton 40 or a signal delivered to another automaton given the task of the automatic loading of the envelopes in the container. It may also be accompanied by the sending of the number of envelopes really placed in the container to a computer system, in order to for the latter to print the label to apply on the container according to the postal requirements.

Figure 3:
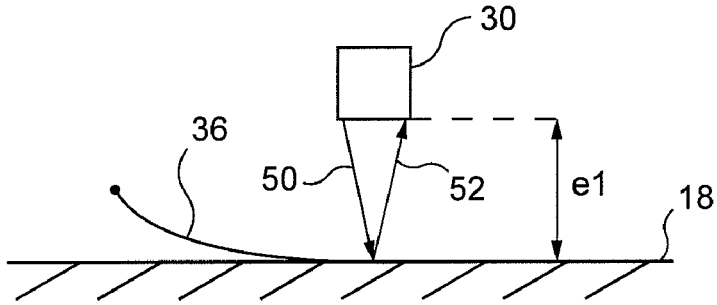
FIGS. 3 and 4 are respective diagrammatic views of the part of the device of FIG. 2 performing the thickness measurement.
Figure 4:
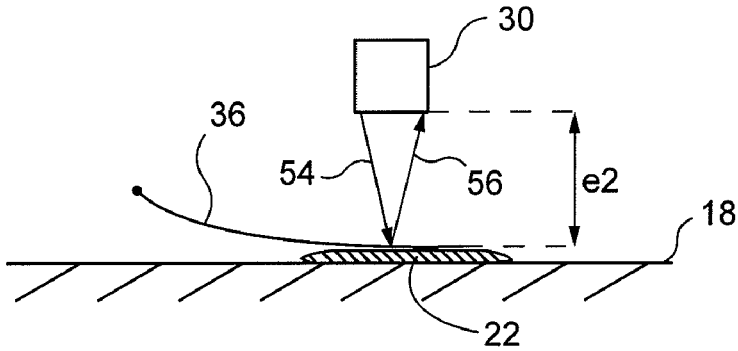

As represented in FIGS. 3 and 4, the measurements are more particularly carried out by a laser cell 30 which measures the movement of the reference surface 36 rising on passage of an envelope 22. The cell 30 continuously supplies a measurement representing the position of the surface 36. At the time of the calibration phase a first measurement is carried out when empty (without envelope on the support 18) and recorded by the automaton 40. More particularly, this measurement is carried out on the basis of the source 30 which emits an electromagnetic signal, in this case a laser light signal 50, towards the reference surface 36 which, in this position, presses against the support 18. The source next receives the signal 52 reflected by the reference surface.

The measuring means determine a distance e1 corresponding to the distance between the source 30 and the reference surface 36 by measurement of the time necessary for the signal to propagate from the source to the surface 36 and return to the source 30. The measurement e1 corresponds to what referred to as a resting measurement of the reference surface 36. Next, an envelope such as the envelope 22 is conveyed over the support 18 and comes into position facing the measuring means 30. This envelope becomes inserted under the reference surface 36, between the latter and the top surface of the support 18, by slightly deforming the latter so as to bring it closer to the measuring means 30 (measuring position).

In a similar manner to that described for FIG. 3, a distance e2 is thus measured between the means 30 and the reference surface 36 when the latter is moved through a distance corresponding to the thickness of the envelope (the thickness of the envelope is thus indirectly measured with that reference surface). The automaton 40 takes the difference between these two distances e1 and e2 and thus determines the thickness of the envelope 22, taking into account the known thickness of the strip 36.

Figure 5:
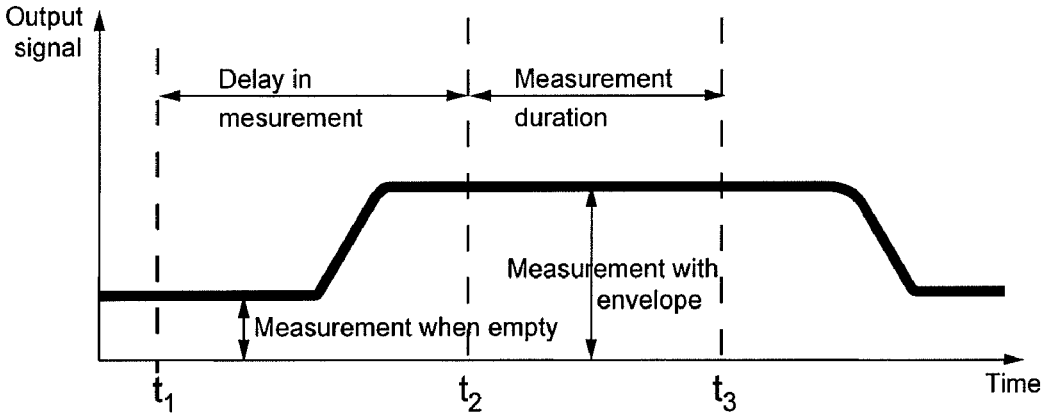
FIG. 5 is a diagram of principle illustrating the periods of measurement in relation to the temporal evolution of the output signal of the optical measuring means.

The principle of measurement is illustrated in FIG. 5 which diagrammatically represents the value of the output signal of the measuring means 30 and which represents the magnitude of the reflected signal received by the cell 30.

It may thus be understood that starting from the time t1 at which the passage of an envelope is detected by the cell 26, a measurement when empty (without any envelope) is then carried out as indicated in relation to FIG. 3, for an interval corresponding to the delay before the measurement. At the end of this time interval, at the time t2 there commences the interval corresponding to the duration of the measurement and, during that specific time window (t3-t2), a measurement is carried out with the envelope as indicated with reference to FIG. 5. It will be noted that the measurement is carried out when the output signal delivered by the measuring means 30 is stable and not in its transient period situated before the time t2.

It should be noted that the measuring means 30 used output the analog signal of which the appearance is represented in FIG. 5. It may for example be a DC voltage signal. Thus, the use of such measuring means makes it possible to dispense with having to parameterize/set the measuring means, in addition to the parameterization/setting of the automaton 40. This signal is transmitted to the automaton 40 where it is sampled, for example, every 3 or 4 ms and an average of all these sampled values is then taken. Thus, the measurements carried out starting from the time t1 in FIG. 5 (measurement when empty) and between the times t2 and t3 (measurement with the envelope) correspond in fact each time to an average value of several numerical values sampled from the signal of FIG. 5 over the interval of time considered As noted previously, the flexible reference strip 36 conjointly serves as reference surface for the envelope thickness measurement and as a compressing device driving out the air contained in the filled envelope directly beneath the zone where the thickness measurement is carried out.

Figure 6:
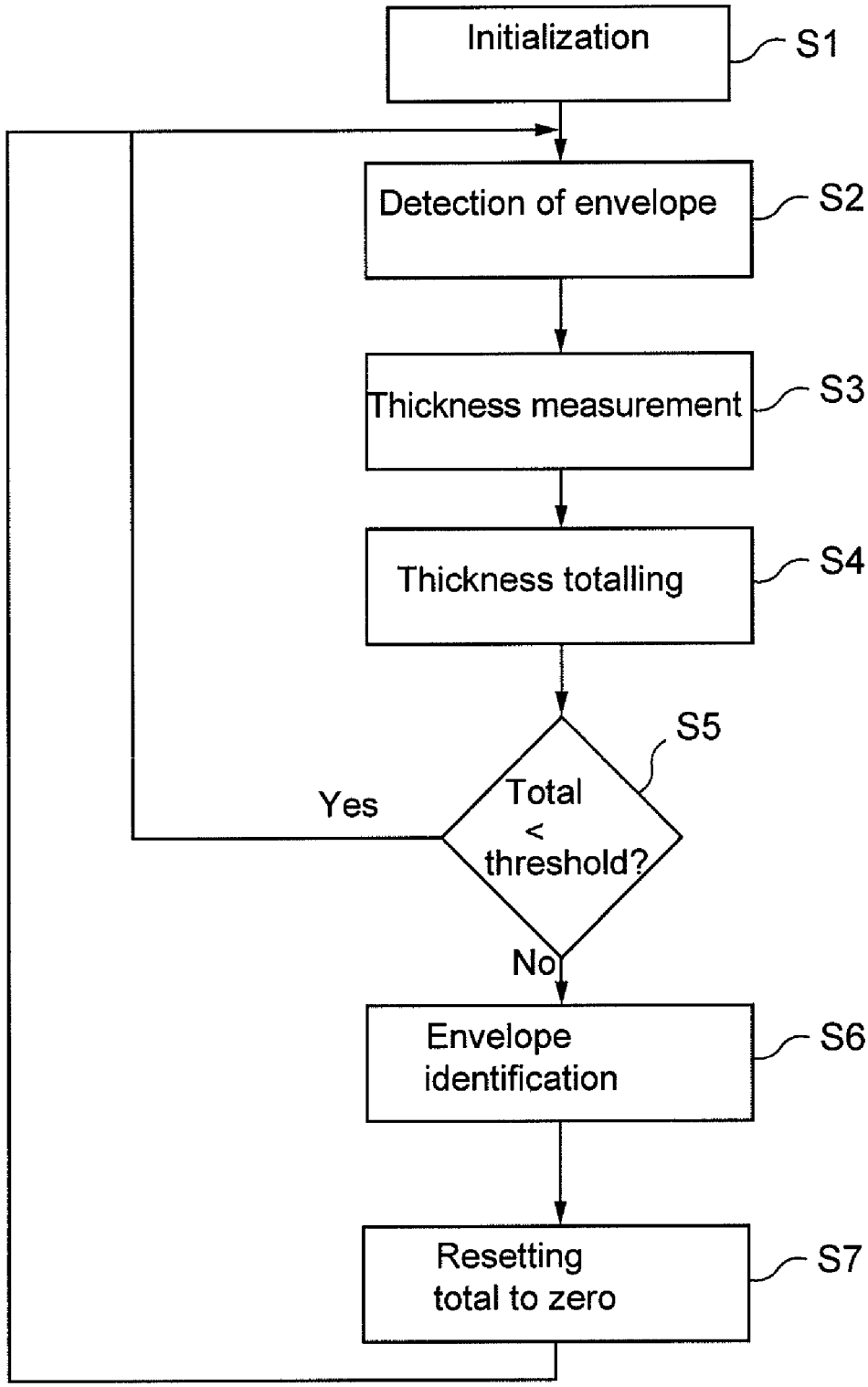
FIG. 6 is a diagrammatic view of an algorithm illustrating the steps of the method according to an illustrative embodiment of the invention.

FIG. 6 is an algorithm comprising a sequence of instructions of which the execution enables the implementation of the method according to an embodiment of the invention. This algorithm is stored on an information carrier present in the automaton 40 such as a memory space of a hard disk or in a ROM type memory. For its execution, the algorithm is transferred into a memory of RAM type.

This algorithm comprises a first step E1 of initialization during which different parameters may be entered by a user of the system into the automaton 40 by means of the keyboard 42. During this step, a procedure of automatic calibration is carried out with the cell 30 in order to perform and record a measurement when empty as represented in FIG. 3.

This measurement when empty is carried out during the initialization step S1 of the algorithm of FIG. 6. Parameters are thus fixed during this step making it possible to take into account, in particular, particular physical characteristics of each enveloping machine and, also, of characteristics that are specific to the loading of the envelopes as well as to the containers used.

During the following step S2, by virtue of a detection cell 30, detection is made of the envelopes coming from the enveloping machine and which are conveyed to the loading station. Thus, as represented in FIG. 2, the cell 30 detects the passage of a filled envelope 20 at a given place, situated between the enveloping machine and the loading station.

The following step S3 provides at the next station of FIG. 2 for measuring the thickness of the envelope 20 of which the passage was detected at step S2. The measurement of the thickness of the envelope is carried out as explained earlier with reference in particular to FIGS. 3 and 4.

During the following step S4 the thickness which has just been measured is stored in a register of the automaton 40, and this thickness is added to the sum of the thicknesses of a plurality of filled envelopes which have just been determined since the start of the filling of the container.

In this case, as it is the first envelope which has just been detected at step S2, the register is empty and only the thickness measured at step S3 is recorded at step S4. Nevertheless, when it is not the first envelope which has just been detected at step S2, a total is calculated during step S4 of the thicknesses measured earlier for a plurality of filled envelopes which have been loaded into the container.

During the following step S5, a comparison is made with respect to a predetermined threshold of the sum of the thicknesses which have been determined earlier for that plurality of filled envelopes.

The threshold is a value which can be parameterized which takes into account in particular the internal dimensions of the container in which the envelopes are loaded and the postal requirements relating to the necessary play between the envelopes and the inside walls of the container (the play must be sufficient to slide in a hand and thus to enable a packet of envelopes to be taken but must not be greater than ten centimeters or so to avoid the envelopes being dispersed within the container). It the total of the real thicknesses determined at step S4 remains less than the threshold, processing of the following envelopes is continued by returning to step S2 since the container can still receive other envelopes before it is considered to be filled. On the other hand, if the sum of the thicknesses attains or exceeds the predetermined threshold, this means that the container has been filled or is on the point of being filled with the last envelope of which the thickness has just been measured at step S3. Thus, step S5 makes it possible to evaluate in real time the degree of filling with envelopes of the container and thus to take a decision on the loading of that container.

Step S5 is next followed by a step S6 during which it is decided to identify the next envelope (first envelope of the plurality of following envelopes), for example, by marking it physically, using the marker 38 of FIG. 2, with a line of color. Alternatively, it may be decided to identify the last envelope of the batch of envelopes which has just been processed. Nevertheless, this variant embodiment is less reliable than the identification of the first envelope of a batch of envelopes, for example, with respect to the case in which the last envelope of a batch is lost.

As noted earlier, the identification of the envelope may also be made by other means, whether audio or visual.

It will be noted that the identification of the envelope at step S6 enables the operator situated at the loading station 16 of FIG. 1 to remove the filled container before installing a new empty one ready to fill, starting with the envelope identified. The operator may alternatively, with the identification of the last envelope at step S6, place it in the container and then perform the exchange of container to install an empty one.

The following step S7 provides for resetting to zero the register in which is stored the total of the thicknesses at step S4 in order to be able to process a new plurality of filled envelopes (next batch) as set out above with reference to steps S2 to S6 of the algorithm. The user terminates that algorithm at any time by interacting with the interface 40 of FIG. 2. In case of a connection with an external computer device, this causes the sending of the number of envelopes present in the container present at the loading station.

What is claimed is:

1. A method of determining the degree of filling of a container with filled envelopes using an instruction processor, characterized in that the method comprising:

dynamically determining the real thickness of each of the filled envelopes of a plurality of filled envelopes using a measuring device before it is loaded into the container;

using the instruction processor to evaluate the degree of filling of the container on the basis of the real thicknesses of envelopes thus determined;

using the instruction processor to total the sum of the determined real thicknesses for the plurality of filled envelopes.

using the instruction processor to compare the sum of the determined real thicknesses for the plurality of filled envelopes with respect to a predetermined threshold; and depending solely on the result of the comparison, deciding to identify using the instruction processor at least one of the last envelope of which the thickness has been determined or of the first envelope of the following plurality of envelopes, in order to indicate that the container is full.

2. The method according to claim 1, wherein the identification of the envelope is carried out by a marking operation of that envelope.

3. A method of loading a container with filled envelopes comprising:

conveying a plurality of filled envelopes from an enveloping machine to a loading station, loading the filled envelopes into the container, characterized in that the method further comprises:

dynamically determining the real thickness of each of the filled envelopes before it is loaded into the container, evaluating the degree of filling of the container solely on the basis of the real thicknesses of envelopes thus determined, wherein, determining the real thickness of a filled envelope is carried out by at least one optical thickness measurement.

4. The method according to claim 3 wherein the degree of filling of the container is also determined on the basis of the internal dimensions of the container.

5. The method according to claim 3, further comprising totaling the sum of the determined real thicknesses for the plurality of filled envelopes.

6. The method according to claim 5, further comprising comparing the sum of the determined real thicknesses for the plurality of filled envelopes with respect to a predetermined threshold; and depending on the result of the comparison, deciding to identify at least one of the last envelope of which the thickness has been determined or of the first envelope of the following plurality of envelopes, in order to indicate that the container is full.

7. The method according to claim 6, wherein the identification of the envelope is carried out by a marking operation of that envelope.

8. The method according to claim 3, wherein making the thickness measurement comprises:

sending at least one electromagnetic signal from a signal source towards a reference surface and receiving what is referred to as the reference signal reflected by the reference surface, sending at least one electromagnetic signal towards the reference surface which is placed on the path of a filled envelope and which is brought closer to the signal source on passage of that filled envelope and receiving what is referred to as the measurement signal reflected by the reference surface, and measuring the real thickness of the envelope on the basis of the reference signal and measurement signal that are reflected by the reference surface.

9. The method according to claim 1 further comprising:

expelling air from the envelope in order to determine the real thickness of the latter.

10. The method according to claim 3 further comprising:

expelling air from the envelope in order to determine the real thickness of the latter.

11. The method according to claim 8 wherein, the reference surface placed on the path of the envelopes is both flexible so as to elastically deform on passage of a filled envelope and sufficiently rigid to exert a compressive force on the envelope tending to expel air therefrom.

12. A device for loading a container with filled envelopes comprising:

means for conveying a plurality of filled envelopes from an enveloping machine to a loading station, means for loading the filled envelopes into the container, means for dynamically determining the real thickness of each of the filled envelopes before it is loaded into the container, means for evaluating the degree of filling of the container solely on the basis of the real thicknesses of envelopes thus determined, wherein, the means for dynamically determining the real thickness of each of the envelopes comprises an optical thickness measuring means.

13. The device according to claim 12, wherein the optical measuring means are associated with a reference surface.

14. The device according to claim 12 wherein the thickness measuring means comprise:

means for sending at least one electromagnetic signal from a signal source towards a reference surface and for receiving what is referred to as the reference signal reflected by the reference surface, means for sending at least one electromagnetic signal towards the reference surface which is placed on the path of a filled envelope and which is brought closer to the signal source on passage of that filled envelope and for receiving what is referred to as the measurement signal reflected by the reference surface, and means for measuring the real thickness of the envelope on the basis of the reference signal and measurement signal that are reflected by the reference surface.

15. The device according to claim 14, wherein the reference surface placed on the path of the envelopes is both flexible so as to elastically deform on passage of a filled envelope and sufficiently rigid to exert a compressive force on the envelope tending to expel air therefrom.

16. The device according to claim 12, further comprising:

means for totaling the sum of the determined real thicknesses for the plurality of filled envelopes;

means for comparing the sum of the determined real thicknesses for the plurality of filled envelopes with respect to a predetermined threshold; and depending on the result of the comparison, means for deciding to identify at least one of the last envelope of which the thickness has been determined or of the first envelope of the following plurality of envelopes, in order to indicate that the container is full.

17. The device according to claim 16, wherein the means for identification of the envelope is carried out by a marking operation of that envelope.

18. The method according to claim 1, wherein dynamically determining the real thickness of each of the filled envelopes comprises pinching each of the filled envelopes to eliminate air.

19. The method according to claim 3, wherein dynamically determining the real thickness of each of the filled envelopes comprises pinching each of the filled envelopes to eliminate air.

20. The device according to claim 12, wherein the means for dynamically determining the real thickness of each of the filled envelopes comprises means for pinching each of the filled envelopes to eliminate air.

* * * * *